US009524733B2

(12) United States Patent
Skoglund et al.

(10) Patent No.: US 9,524,733 B2
(45) Date of Patent: Dec. 20, 2016

(54) OBJECTIVE SPEECH QUALITY METRIC

(71) Applicant: Google Inc., Mountain View, CA (US)

(72) Inventors: Jan Skoglund, Mountain View, CA (US); Andrew J. Hines, Dublin (IE); Noami A. Harte, Dublin (IE); Anil Kokaram, Mountain View, CA (US)

(73) Assignee: Google Inc., Mountain View, CA (US)

( * ) Notice: Subject to any disclaimer, the term of this patent is extended or adjusted under 35 U.S.C. 154(b) by 529 days.

(21) Appl. No.: 13/891,978

(22) Filed: May 10, 2013

(65) Prior Publication Data

US 2015/0199959 A1 Jul. 16, 2015

Related U.S. Application Data

(60) Provisional application No. 61/645,433, filed on May 10, 2012.

(51) Int. Cl.
*G10L 25/60* (2013.01)

(52) U.S. Cl.
CPC ..... *G10L 25/60* (2013.01)

(58) Field of Classification Search
USPC ..... 704/239
See application file for complete search history.

(56) References Cited

U.S. PATENT DOCUMENTS 5,327,257 A * 7/1994 Hrytzak ..... G06F 17/175 358/1.9
2005/0288923 A1* 12/2005 Kok ..... 704/226
2008/0106249 A1* 5/2008 Barrett et al. ..... 324/76.38
2008/0195382 A1* 8/2008 Krini ..... G10L 19/0204 704/203
2014/0294188 A1* 10/2014 Rini ..... H04R 25/70 381/60

OTHER PUBLICATIONS

Drews et al., A Neurogram Matching Similarity Index (NMSI) for the Assessment of Audio Quality, Sep. 2013.*
Hines et al., Speech intelligibility from image processing, ScienceDirect, Speech Communication 52 (2010) 736-752, Apr. 27, 2010.*
Kawahara et al., Technical foundations of Tandem-Straight, a speech analysis, modification and synthesis framework, Indian Academy of Sciences, Sadhana vol. 36, Part 5, Oct. 2011, pp. 713-727.*
Robinson, Speech Analysis, 1998.*
(Continued)

*Primary Examiner* — Barbara Reinier
(74) *Attorney, Agent, or Firm* — Brake Hughes Bellermann LLP

(57) ABSTRACT

Methods and systems are provided for using a model of human speech quality perception to provide an objective measure for predicting subjective quality assessments. A Virtual Speech Quality Objective Listener (ViSQOL) model is a signal-based full-reference metric that uses a spectro-temporal measure of similarity between a reference signal and test speech signal. Specifically, the model provides for the ability to detect and predict the level of clock drift, and determine whether such clock drift will impact a listener's quality of experience.

26 Claims, 9 Drawing Sheets

(56) References Cited

OTHER PUBLICATIONS

Hines et al., Speech intelligibility prediction using a Neurogram Similarity Index Measure, online Sep. 29, 2011, Speech Communication 54 (2012) 306-320.*

A. Hines and N. Harte, "Comparing hearing-aid algorithm performance using Simulated Performance Intensity Functions," in Speech Perception and Auditory Disorders, Int. Symposium on Audiological and Auditory Research (ISAAR), 2011.

ITU, "Perceptual evaluation of speech quality (PESQ): An objective method for end-to-end speech quality assessment of narrow-band telephone networks and speech codecs," Int. Telecomm. Union, Geneva, Switzerland, ITU-T Rec. p. 862, Feb. 2001.

ITU, "Perceptual objective listening quality assessment," Int. Telecomm. Union, Geneva, Switzerland, ITU-T Rec. p. 863, Jan. 2011.

A. Hines and N. Harte, "Speech intelligibility prediction using a neurogram similiarity index measure," Speech Communication, vol. 54. No. 2, pp. 306-320, 2012.

IEEE, "IEEE recommended practice for speech quality measurements", IEEE Transactions on Audio and Electroacoustics, vol. AU-17, No. 3, pp. 225-246, Sep. 1969.

ITU, "Mapping function for transforming P.862 raw result scores to MOS-LQO", Int. Telecomm. Union, Geneva, Switzerland, ITU-T Rec. p. 862.1, Nov. 2003.

W. Jiang and H. Schulzrinne, "QoS measurement of internet real-time multimedia services," Technical report CUCS-015-99, Columbia University, Dec. 1999.

W. Voiers, "Interdependencies among measures of speech intelligility and speech quality", ICASSP 80 Proceedings, IEEE International Conference on Acoustics, Speech, and Signal Processing, vol. 1, pp. 703-705, Apr. 9-11, 1980.

* cited by examiner

OBJECTIVE SPEECH QUALITY METRIC

The present application claims priority to U.S. Provisional Patent Application Ser. No. 61/645,433, filed May 10, 2012, the entire disclosure of which is hereby incorporated by reference.

BACKGROUND

PESQ (Perceptual Evaluation of Speech Quality) and its successor POLQA (Perceptual Objective Listening Quality Assessment) are full-reference measures described in ITU standards that allow for prediction of speech quality by comparing a reference signal to a received signal. However, clock drift is a commonly encountered problem in many systems (e.g., VoIP systems), and can cause a drop in speech quality estimates from PESQ or POLQA.

While there may be a range of QoS (Quality of Service) metrics available to predict delay and clock drift, such metrics are limited in their abilities to predict the end-user perceptual quality of experience.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to systems and methods for audio signal processing. More specifically, aspects of the present disclosure relate to audio/speech quality prediction.

One embodiment of the present disclosure relates to a method for determining speech quality, the method comprising: receiving a first signal and a second signal, wherein the second signal is a degraded version of the first signal; creating a time-frequency representation for each of the two signals; using the time-frequency representation for the first signal to select at least one portion of the first signal containing speech data; identifying at least one portion of the second signal corresponding to the at least one portion of the first signal; determining a level of similarity between the second signal and the first signal based on a comparison of the at least one portion of the second signal and the corresponding at least one portion of the first signal; and generating a speech quality estimate based on the level of similarity.

In another embodiment of the method for determining speech quality, the creation of the time-frequency representation for each of the two signals includes using a 512-sample, 50% overlap Hamming window for signals with 16 kHz sampling rate and a 256-sample window for signals with 8 kHz sampling rate.

In another embodiment of the method for determining speech quality, using the time-frequency representation for the first signal to select at least one portion of the first signal containing speech data includes selecting patches of interest from the time-frequency representation for the first signal, each of the patches of interest including 30 frames of the first signal and 30 frequency bands.

In another embodiment of the method for determining speech quality, using the time-frequency representation for the first signal to select at least one portion of the first signal containing speech data includes selecting patches of interest from the time-frequency representation for the first signal, each of the patches of interest including 30 frames of the first signal and 23 frequency bands.

In another embodiment of the method for determining speech quality, using the time-frequency representation for the first signal to select at least one portion of the first signal containing speech data includes determining a maximum intensity frame in each of a plurality of frequency bands in the time-frequency representation for the first signal.

In yet another embodiment of the method for determining speech quality, identifying the at least one portion of the second signal corresponding to the at least one portion of the first signal includes performing a relative mean squared error difference between the at least one portion of the first signal and the corresponding at least one portion of the second signal to identify a maximum correlation frame index for the at least one portion of the first signal.

In still another embodiment, the method for determining speech quality further comprises: creating warped versions of the at least one portion of the first signal; determining a level of similarity between the at least one portion of the second signal and the corresponding at least one portion of the first signal; determining a level of similarity between the at least one portion of the second signal and each of the warped versions of the at least one portion of the first signal; calculating an average of the levels of similarity between the at least one portion of the second signal and the corresponding at least one portion of the first signal, and between the at least one portion of the second signal and each of the warped versions of the at least one portion of the first signal; and generating a signal similarity estimate based on the average of the levels of similarity.

Another embodiment of the present disclosure relates to a system for determining speech quality, the system comprising: one or more processors; and a computer-readable medium coupled to said one or more processors having instructions stored thereon that, when executed by said one or more processors, cause said one or more processors to perform operations comprising: receiving a first signal and a second signal, wherein the second signal is a degraded version of the first signal; creating a time-frequency representation for each of the two signals; using the time-frequency representation for the first signal to select at least one portion of the first signal containing speech data; identifying at least one portion of the second signal corresponding to the at least one portion of the first signal; determining a level of similarity between the second signal and the first signal based on a comparison of the at least one portion of the second signal and the corresponding at least one portion of the first signal; and generating a speech quality estimate based on the level of similarity.

In another embodiment of the system for determining speech quality, the one or more processors are further caused to perform operations comprising creating the time-frequency representation for each of the two signals using a 512-sample, 50% overlap Hamming window for signals with 16 kHz sampling rate and a 256-sample window for signals with 8 kHz sampling rate.

In another embodiment of the system for determining speech quality, the one or more processors are further caused to perform operations comprising identifying the at least one portion of the second signal corresponding to the at least one portion of the first signal using the time-frequency representation created for the second signal.

In another embodiment of the system for determining speech quality, the one or more processors are further caused to perform operations comprising selecting patches of interest from the time-frequency representation for the first signal, each of the patches of interest including 30 frames of the first signal and 30 frequency bands.

In yet another embodiment of the system for determining speech quality, the one or more processors are further caused to perform operations comprising selecting patches of interest from the time-frequency representation for the first signal, each of the patches of interest including 30 frames of the first signal and 23 frequency bands.

In still another embodiment of the system for determining speech quality, the one or more processors are further caused to perform operations comprising determining a maximum intensity frame in each of a plurality of frequency bands in the time-frequency representation for the first signal.

In another embodiment of the system for determining speech quality, the one or more processors are further caused to perform operations comprising performing a relative mean squared error difference between the at least one portion of the first signal and the corresponding at least one portion of the second signal to identify a maximum correlation frame index for the at least one portion of the first signal.

In yet another embodiment of the system for determining speech quality, the one or more processors are further caused to perform operations comprising: creating warped versions of the at least one portion of the first signal; determining a level of similarity between the at least one portion of the second signal and the corresponding at least one portion of the first signal; determining a level of similarity between the at least one portion of the second signal and each of the warped versions of the at least one portion of the first signal; calculating an average of the levels of similarity between the at least one portion of the second signal and the corresponding at least one portion of the first signal, and between the at least one portion of the second signal and each of the warped versions of the at least one portion of the first signal; and generating a signal similarity estimate based on the average of the levels of similarity.

In one or more other embodiments, the methods and systems described herein may optionally include one or more of the following additional features: the time-frequency representation for each of the two signals is a spectrogram, each of the time-frequency representations is a short-term Fourier transform (STFT) spectrogram representation created with 30 frequency bands logarithmically-spaced between 250 and 8,000 Hz; the at least one portion of the second signal corresponding to the at least one portion of the first signal is identified using the time-frequency representation created for the second signal; the plurality of frequency bands correspond to 250 Hz, 450 Hz, and 750 Hz; the comparison of the at least one portion of the second signal and the corresponding at least one portion of the first signal is performed using Neurogram Similarity Index Measure (NSIM); each of the warped versions of the at least one portion of the first signal is 1% to 5% longer or 1% to 5% shorter than the at least one portion of the first signal; the warped versions of the at least one portion of the first signal are created using a cubic two-dimensional interpolation; the first signal is a short speech reference signal.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
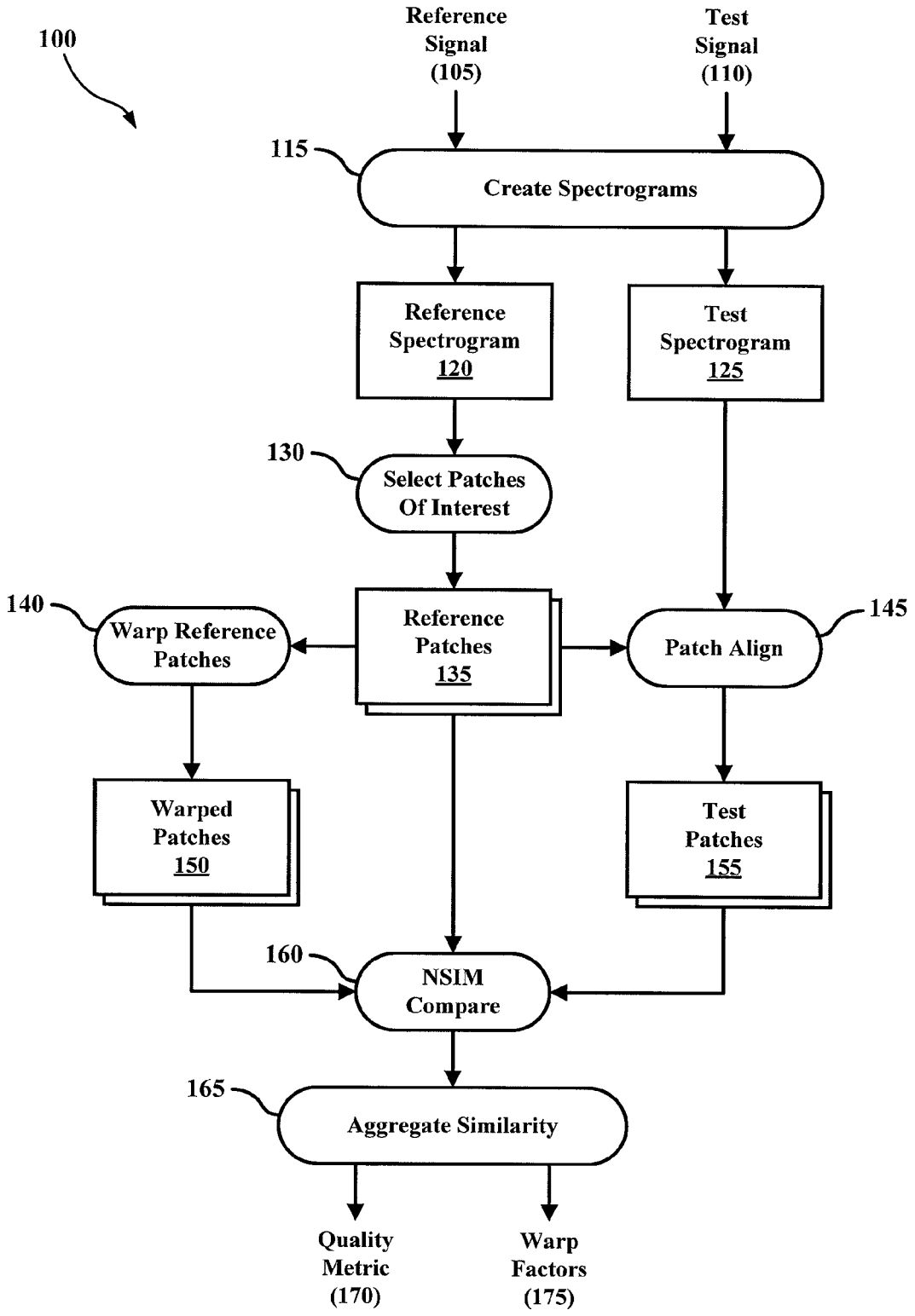
FIG. 1 is a flowchart illustrating an example virtual speech quality objective listener model according to one or more embodiments described herein.

The headings provided herein are for convenience only and do not necessarily affect the scope or meaning of the claimed embodiments.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples and embodiments. One skilled in the relevant art will understand, however, that the examples and embodiments described herein may be practiced without many of these details. Likewise, one skilled in the relevant art will also understand that the examples and embodiments described herein can include many other obvious features not described in detail herein. Additionally, some well-known structures or functions may not be shown or described in detail below, so as to avoid unnecessarily obscuring the relevant description.

Embodiments of the present disclosure relate to a model of human speech quality perception that has been developed to provide an objective measure for predicting subjective quality assessments. The Virtual Speech Quality Objective Listener (ViSQOL) model is a signal-based full-reference metric that uses a spectro-temporal measure of similarity between a reference and a test speech signal. The sections that follow will describe details of the algorithm and compare the results with PESQ for common problems in Voice-over-Internet-Protocol (VoIP) (e.g., clock drift, associated time warping, jitter, etc.). As will be further described below, the results indicate that ViSQOL is less prone to underestimation of speech quality in both scenarios than is the International Telecommunication Union (ITU) standard.

1. Introduction

Perceptual measures of quality of experience rather than quality of service are becoming more important as transmission channels for human speech communication have evolved from a dominance of POTS (Plain Old Telephone Service) to a greater reliance on VoIP. Accurate reproduction of the input signal is less important, as long as the user perceives the output signal as a high quality representation of the original input.

PESQ (Perceptual Evaluation of Speech Quality) and its successor POLQA (Perceptual Objective Listening Quality Assessment) are full-reference measures described in ITU standards that allow for prediction of speech quality by comparing a reference signal to a received signal. PESQ was developed to give an objective estimate of narrowband speech quality. The newer POLQA model yields quality estimates for both narrowband and super-wideband speech, and addresses other limitations in PESQ. Additionally, NSIM (Neurogram Similarity Index Measure) was originally developed as a full-reference measure for predicting speech intelligibility.

As will be further described herein, the present disclosure adapts the NSIM methodology to the domain of speech quality prediction, with specific concentration on areas of speech quality assessment where PESQ and POLQA have known weaknesses. Clock drift is a commonly encountered problem in VoIP systems, and can cause a drop in speech quality estimates from PESQ or POLQA. However, clock drift does not have a noticeable impact on the user's perception of speech quality. Small resulting changes, such as some temporal or frequency warping, may be imperceptible to the human ear and should not necessarily be judged as a quality degradation. Furthermore, jitter may not always be fully corrected in cases where the jitter buffer is not sufficiently long, even with no packet loss. This can cause the speed of the received signal to be increased or decreased to maintain overall delay, an effect that will not impact overall perceived quality in a call when low enough.

The following presents an analysis of the use of NSIM as the basis of the development of a Virtual Speech Quality Objective Listener (ViSQOL) model. Realistic examples of time warping and jitter are assessed for speech quality using PESQ and the results are compared to the newly developed ViSQOL. The following also provides further background on the measures of PESQ and NSIM, describes the ViSQOL model architecture, introduces experiments involving clock drift and jitter typical of modern VoIP communications, and highlights the ViSQOL model's ability to predict and estimate time warping while describing its further potential.

2. Quality Measures

2.1. PESQ

PESQ is a full reference comparison metric that compares two signals before and after passing through a communications channel to predict speech quality. The signals are time aligned, followed by a quality calculation based on a psychophysical representation. Quality is scored in a range of −0.5 to 4.5, although the results for speech are usually in the range of 1 to 4.5.

A transfer function mapping from PESQ to MOS (Mean Opinion Score) has been developed using a large speech corpus. The original PESQ metric was developed for use on narrowband signals (e.g., 300-3,400 Hz) and deals with a range of transmission channel problems including speech input levels, multiple bit rate mode codecs, varying delays, short and long term time warping, packet loss and environmental noise at the transmission side. It is acknowledged in the ITU standard that PESQ provides inaccurate predictions for quality involving a number of other issues including listening levels, loudness loss, effects of delay in conversational tests, talker echo, and side tones. PESQ has evolved over the last decade with a number of extensions.

2.2. NSIM

The Neurogram Similarity Index Measure (NSIM) was developed to evaluate the auditory nerve discharge outputs of models simulating the working of the ear. A neurogram is analogous to a spectrogram with color intensity related to neural firing activity. NSIM rates the similarity of neurograms and can be used as a full-reference metric to predict speech intelligibility.

Speech intelligibility and speech quality are closely related. It has been shown that an amplitude distorted signal that has been peak-clipped does not seriously affect intelligibility, but does seriously affect the aesthetic quality. In evaluating the speech intelligibility provided by two hearing aid algorithms with NSIM, it was noted that while the intelligibility level was the same for both, the NSIM predicted higher levels of similarity for one algorithm over the other. This suggested that NSIM may be a good indicator of other factors beyond intelligibility, such as speech quality.

It was necessary to evaluate intelligibility after the auditory periphery when modeling hearing-impaired listeners, as the signal impairment occurs in the cochlea. The sections that follow describe situations where the degradation occurs in the communication channel, and therefore assessing the signal directly using NSIM on the signal spectrograms, rather than nuerograms, simplifies the model.

3. VISQOL Model Architecture

ViSQOL is a model of human sensitivity to degradations in speech quality. It compares a reference signal with a degraded test signal, and the output is a prediction of speech quality perceived by an average individual. In at least one embodiment of the present disclosure, the ViSQOL model or method 100 used includes the processing steps illustrated in FIG. 1, details of which are provided below. Additionally, in one or more embodiments, the model 100 may also include a regression fitted transfer function.

Referring to the example model (e.g., process, method, etc.) 100 illustrated in FIG. 1, the inputs to the system may include a short speech reference signal 105, which may be, for example, 3-15 seconds, and a degraded version of the reference signal, which for purposes of present example is referred to as test signal 110. The test signal 110 may be compared by the model to estimate the loss of speech quality in the reference signal 105. The input reference signal 105 and test signal 110 may be processed to create spectrograms at block 115, where short-term Fourier transform (STFT)

spectrogram representations of the reference signal 105 and test signal 110 may be created with, for example, 30 frequency bands logarithmically-spaced between 250 and 8,000 Hz. For example, the creation of spectrograms at block 115 may result in reference spectrogram 120 and test spectrogram 125.

In at least one example, a 512-sample, 50% overlap Hamming window may be used for signals with 16 kHz sampling rate and a 256-sample window used for signals with 8 kHz sampling rate to keep frame resolution temporally consistent.

Following the creation of spectrograms (e.g., reference spectrogram 120 and test spectrogram 125) at block 115, the model may then use the reference spectrogram 120 (e.g., based on the reference signal 105) to select patches of interest at block 130. In at least one embodiment, at block 130 three patches of interest may be selected from the reference spectrogram 120 (e.g., from the reference signal 105) for comparison, each 30 frames long by 30 frequency bands. Further, in some embodiments, a subset of 23 bands, for example, 250-3.4 kHz, may be used for narrowband quality assessment.

The bands may be automatically selected by determining the maximum intensity frame in each of three frequency bands (e.g., band numbers 2, 6, and 10, which roughly correspond to 250, 450, and 750 Hz, respectively). Such a mechanism ensures that the patches of interest 135 selected (e.g., at block 130 of the model) contain speech content rather than periods of silence, and are likely to further contain structured vowel phonemes with strongly comparative features. While bands can potentially overlap, there is generally a good spread between them.

The process may then move to patch alignment at block 145, which finds the best (e.g., closest, most similar, etc.) match between each of the reference patches 135 and a corresponding area from the test spectrogram 125. Starting at the beginning of the test spectrogram 125 and moving horizontally across frame by frame, a relative mean squared error (RMSE) difference may be carried out between each reference patch 135 and a test spectrogram patch 155, thereby identifying the maximum correlation frame index for each reference patch 135.

In one or more embodiments, the model illustrated in FIG. 1 uses NSIM to compare patch similarity between a reference patch 135 and a test patch 155. NSIM is more sensitive to time warping than a human listener. Therefore, the model 100 may counteract this sensitivity by warping the spectrogram patches temporally at block 150.

According to at least one embodiment, the model may create alternative reference patches from 1% to 5% longer and shorter than the original reference patches 135. These alternative reference patches may be created, for example, using a cubic two-dimensional interpolation. For each reference patch 135, a NSIM comparison may be performed at block 160, the comparison being between the reference patch 135 and the corresponding test patch 155 and also between each warped version 150 of the reference patch and the corresponding test patch 155. For each of the three test patches 155, the maximum similarity score from comparisons with the corresponding reference patch 135 and warped reference patches 150 may be aggregated at block 165, where the mean NSIM score for the three test patches 155 may be returned as the signal similarity estimate.

In accordance with at least one embodiment, NSIM may output a bounded score between 0 and 1 for the range from "no similarity" to "identical". In at least the example model illustrated in FIG. 1, one output of the model 100 may be a prediction of speech quality 170, which may be measured on a scale of 0 to 1. A secondary output may be a list of the warp factors 175 used by the NSIM comparison at block 160, which can be used, for example, to predict whether the test signal 110 was temporally warped even if the warping is inaudible to a human listener.

Figure 2:
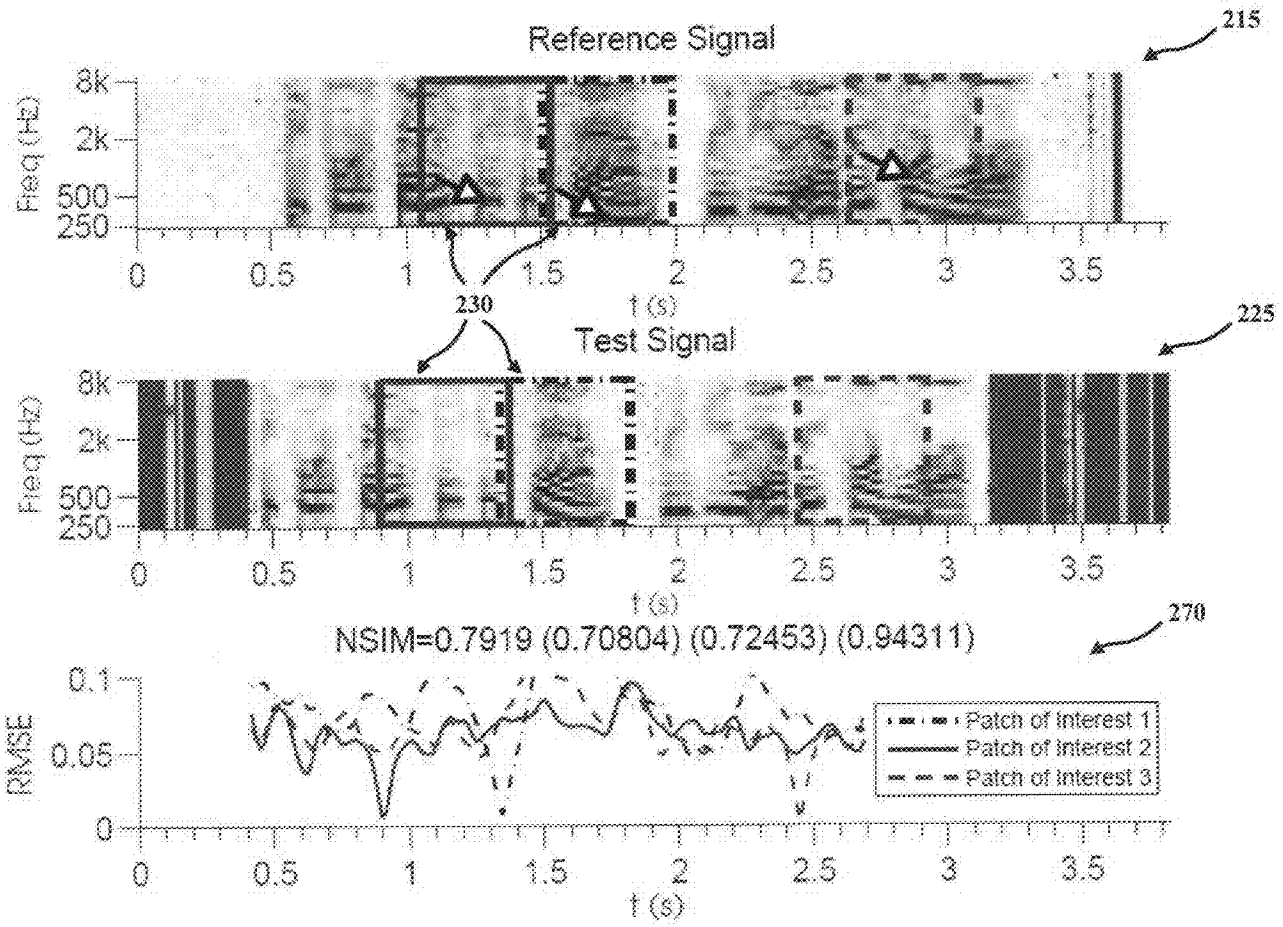
FIG. 2 is a graphical representation of an example spectrogram of an original signal and a degraded signal according to one or more embodiments described herein.

Referring to FIG. 2, illustrated is a jitter signal example. The spectrogram of the original signal 215 (e.g., reference spectrogram 115 as shown in FIG. 1) is shown above the degraded signal 225. The patch windows 230 are shown on both signals, with a small pointer in the center of the reference windows, showing the frequency band used to select the patch of interest (e.g., patch of interest 130 as shown in FIG. 1). In the example shown in FIG. 2, each patch 230 is 30 frames. The RMSE correlation 270 shown in the bottom pane also illustrates how the patches 230 in the degraded signal were aligned to the reference patches (e.g., in patch alignment block 145 as shown in the example process of FIG. 1). The mean NSIM for the three patches is shown with the NSIM per patch in parenthesis.

In the example presented in FIG. 2, the points corresponding to the three frequency bands (e.g., bands 2, 6 and 10, corresponding roughly to 250, 450 and 750 Hz) are marked with a small arrow in the middle of the reference patch (e.g., reference patches 135 as shown in FIG. 1) boxes.

Each reference patch 230 shown in FIG. 2 (which may correspond to the description of reference patches 135 above, and as shown in FIG. 1) is aligned with the corresponding area from the test spectrogram 225 (e.g., test spectrogram 125 as shown in FIG. 1). Further, a relative mean squared error (RMSE) difference can be performed between the reference patch and a test spectrogram patch frame by frame, thereby identifying the maximum correlation point for each patch. The bottom pane 270 illustrated in FIG. 2 shows the RMSE for each patch 230, with the patch windows on the test spectrogram 225 at their RMSE minima.

Referring again to FIG. 1, a portion of the example model 100 illustrated may include a comparison stage that may completed by comparing the test patches 155 to both the reference patches 135 and the warped reference patches 150 using NSIM at block 160. In at least one embodiment, if a warped version of a patch 150 has a higher similarity score, then this score may be used for the patch. The mean NSIM score for the three test patches may be returned as the signal similarity estimate. As described above, NSIM comparison at block 160 may output a bounded score between 0 and 1 for the range "no similarity" to "identical".

4. Example 1

Clock Drift Simulation

The clock drift example simulates time warp distortion of signals due to low frequency clock drift between the signal transmitter and receiver. Clock drift can cause delay problems if not detected, and can significantly impact VoIP conversation quality. However, a small delay (e.g., 1 to 4, or 5%) is unlikely to be noticeable to a listener when comparing over a short speech sample. Clock drift can be mitigated using clock synchronization algorithms at a network level by analyzing packet time-stamps. However, the clock drift can be masked by other factors such as jitter when packets arrive out of synchronization.

In the present example, ten sentences from a speech corpus were used as reference speech signals. The 8 kHz sampled reference signals were originally resampled to create time-warped versions. The reference and resampled test signal were evaluated with both PESQ-LQO and the ViSQOL model. Further, the test was repeated for reference signals with a range of resampled test signals, with resampling factors ranging from 0.85 to 1.15.

Figure 3:
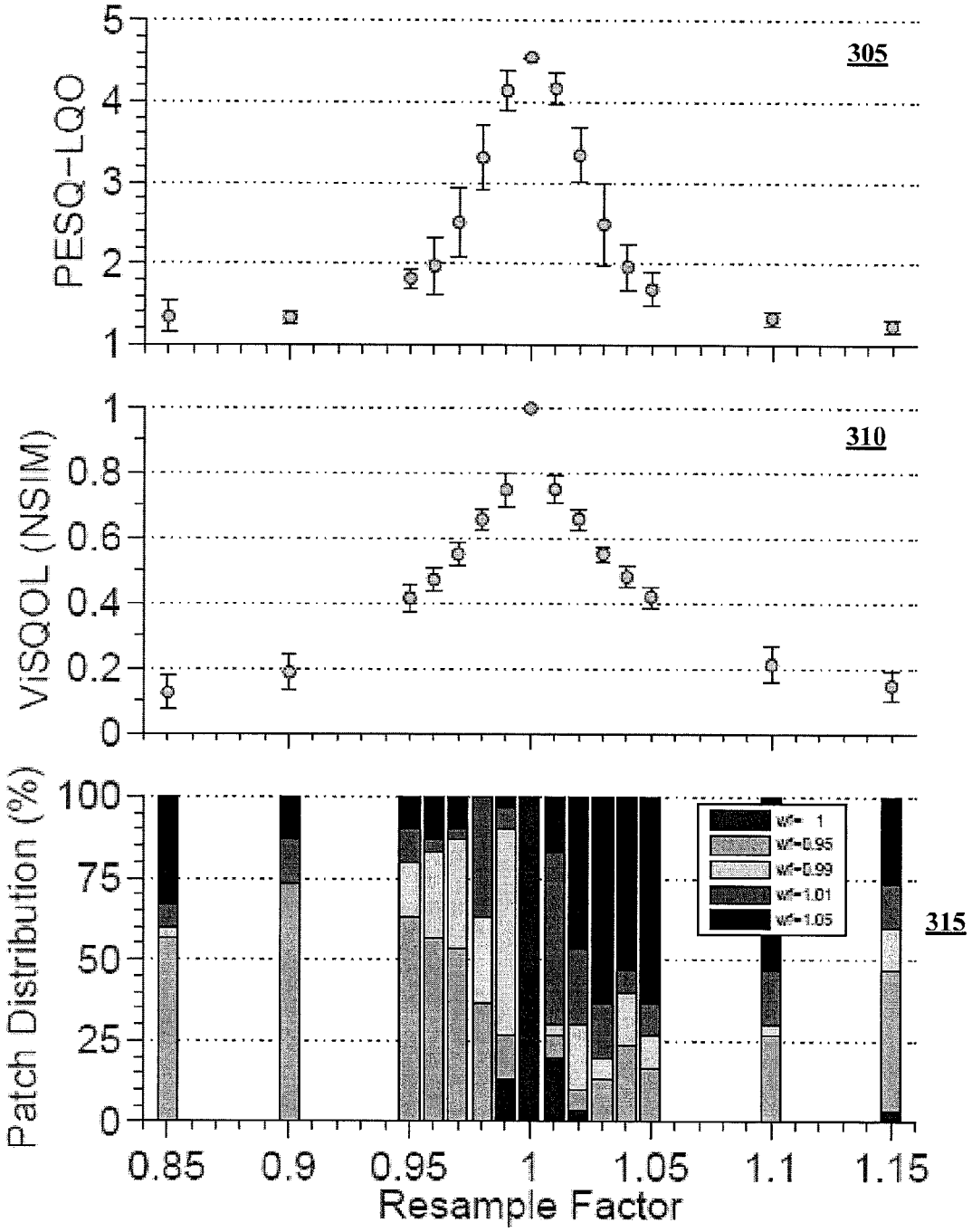
FIG. 3 is a collection of graphical representations illustrating example speech quality predictions according to one or more embodiments described herein.
Figure 4:
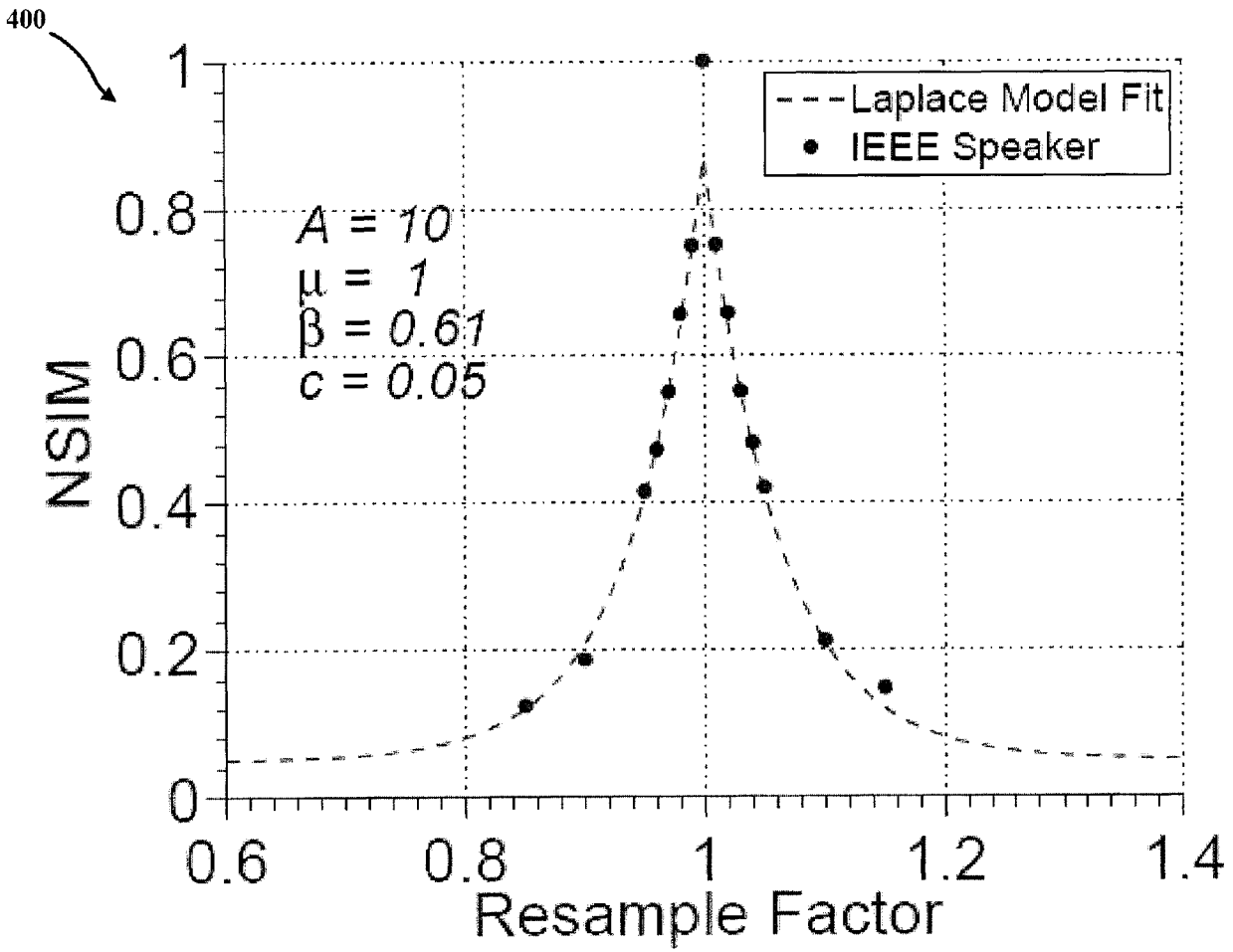
FIG. 4 is a graphical representation illustrating example test results of a model fit of Laplace function to speaker data according to one or more embodiments described herein.
Figure 5:
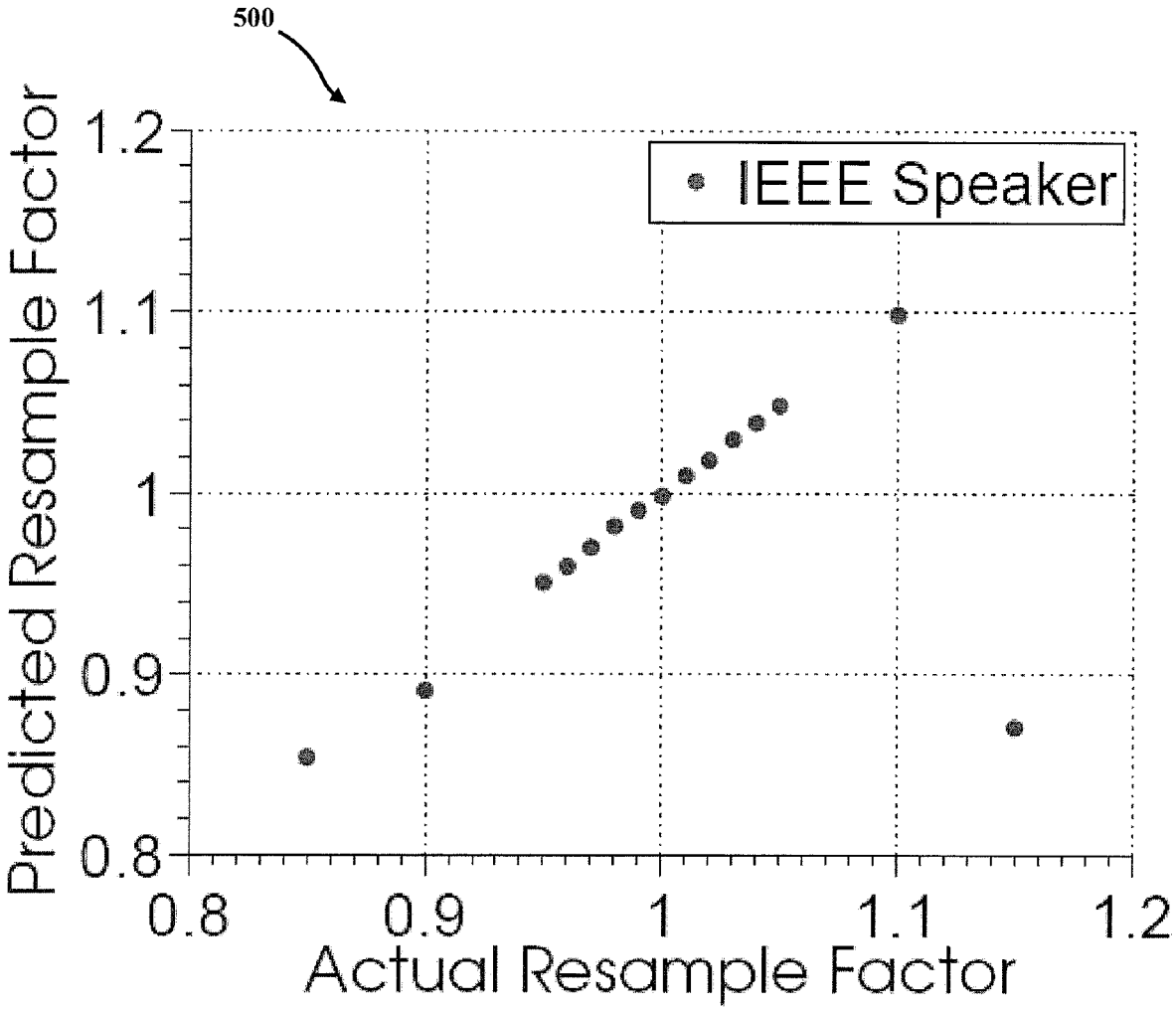
FIG. 5 is a graphical representation illustrating results of mean predicted warp for samples in an example test set according to one or more embodiments described herein.
Figure 6:
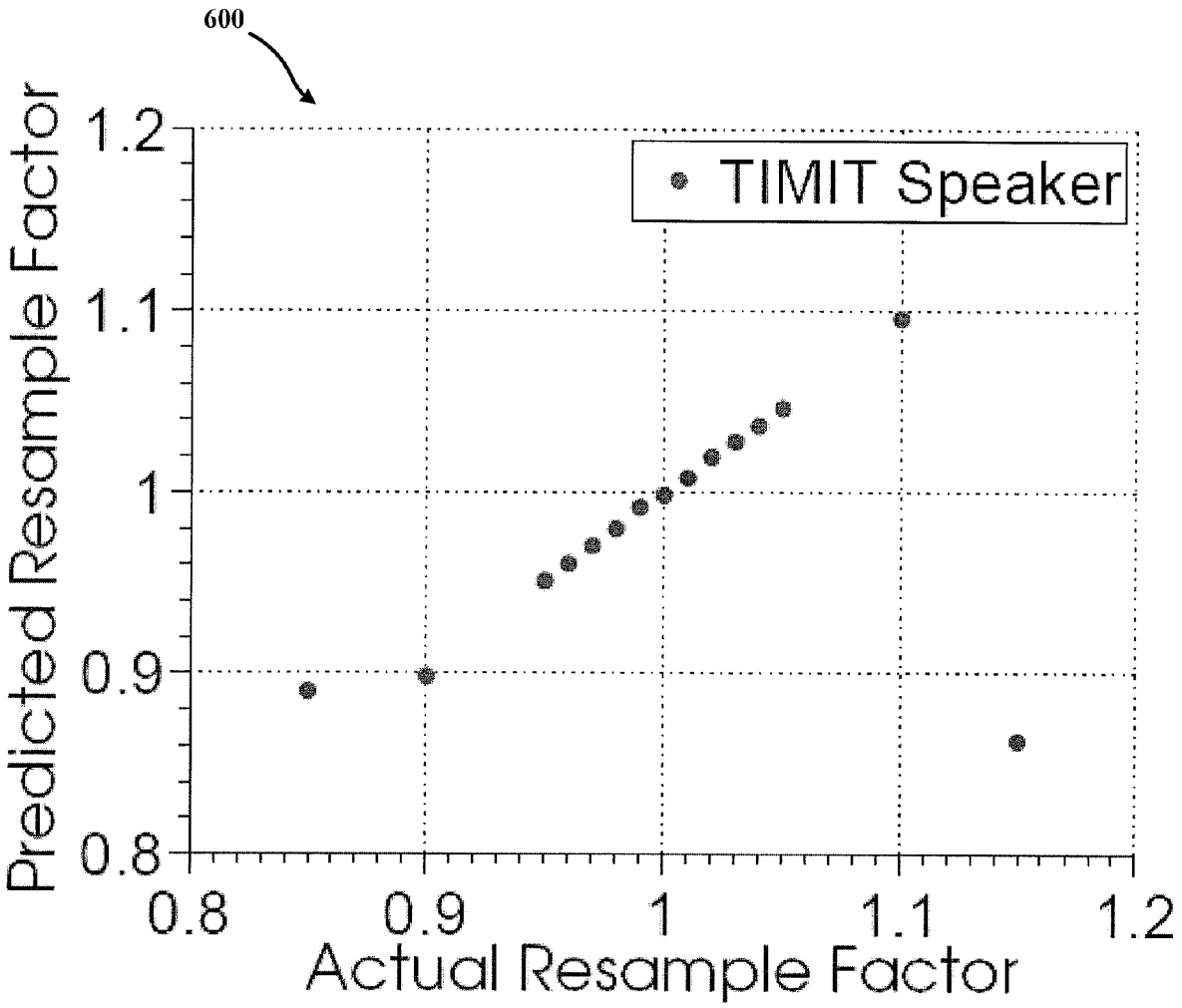
FIG. 6 is a graphical representation illustrating results of mean predicted warp for samples in an example test set according to one or more embodiments described herein.

The results of the example experiment outlined above are presented in FIG. 3. The example illustrated plots speech quality predictions for ten clean narrowband sentences. The two top plots 305 and 310 include PESQ and ViSQOL speech quality predictions, respectively, and show mean values at each resampling factor compared to the reference signals (it should be noted that NSIM is the scale unit). Error bars are standard deviation. Additionally, the bottom plot 315 shows a stack bar breakdown of the warped patches chosen by ViSQOL for the similarity measure. The "wf" in the legend included with the bottom plot refers to the patch warp factor.

Looking at the comparison between the PESQ model 305 and the ViSQOL model 310, it is evident that the full ranges of both metrics are covered by the test. Both follow a similar trend with plateaus at the extremities and symmetry around the non-resampled perfect quality comparison maximum. If the resampled tests are listened to, the differences are not audible at 2% resampling or less. Although a change in pitch is noticeable, the change is not a dramatic degradation in quality until 5% to 10%. The PESQ predictions in plot 305 show a dramatic drop in predicted quality between 3% and 4% resampling, whereas the NSIM drop in plot 310 occurs later, such as between 5% and 10%, which matches the listener experience. The standard deviation for PESQ is significantly larger than for ViSQOL, which is more consistent for the same time warp.

The stacked bar plot 315 illustrates the distribution of warped reference patch (e.g., warped reference patches 140 as shown in FIG. 1) usage by ViSQOL in calculating the NSIM similarity. The y-axis shows the number of patches for each patch warp factor (e.g., warp factors 175 as shown in FIG. 1) that were used with signals of a given resampling. The model uses the maximum similarity from the test patch compared with the reference patch and its warped reference patches (e.g., test patch 155 compared with the references patch 135 and its warped reference patch 150 as shown in FIG. 1).

As the resampling increases, so the warp factor of the selected patches increases. Additionally, the patch distribution shows that the non-resampled reference only uses unwarped patches and the reliance on larger warps grows as the resampling increases. However, less intuitively, the warp factors do not necessarily match exactly with the resampling factors. Further details regarding the NSIM scores combined with knowledge of the warped patches used are provided below, where a potential application of ViSQOL in the detection of clock drift above the network layer is also presented.

4.1. Predicting Time Warping

The ViSQOL output may be used to predict time warping in speech samples by fitting a regression model to the NSIM data. A Laplacian function, $$y = \frac{e^{\frac{-A|x-\mu|}{\beta}}}{2\beta} + c \tag{1}$$

was fitted to the mean NSIM scores for each resample factor. The fitted function is illustrated in FIGS. 4-7. By inverting equation (1), a function for predicting the warp factor for a given NSIM can be obtained as $$x = \frac{b}{A}\ln(2b(y-c)) + \mu,\ 0.06 \geq y \geq 0.89 \tag{2}$$

The symmetrical nature of the above function shown in equation (2) means that it may not predict whether the test signal's resample factor is greater or less than the reference signal. To determine which side of the Laplacian slope should be predicted, the warp factors used in the patches may be examined. A ratio may be formed of patches smaller than the original size to those larger than the original size, and the resample factor prediction may be adjusted to match.

FIGS. 4-7 show the results for a first example speaker test (e.g., IEEE Speaker, which may be referred to as "Test A Speaker"), which was used to obtain the model fit, as well as two other example speaker tests (e.g., TIMIT Speaker and Jitter Warp Speaker, which may be referred to as "Test B Speaker" and "Test C Speaker," respectively). The results for Test A Speaker are plotted in FIG. 5, the results for Test B Speaker plotted in FIG. 6, and the results for Test C Speaker plotted in FIG. 7.

Each test features a single speaker and ten reference sentences with fourteen warp factors per sentence. The scatter diagrams 400, 500, 600, and 700 show the actual resample factor plotted on the x-axis against the predicted resample factor on the y-axis. The points are mean predicted values for the ten sentences. It is clear from the results depicted in FIGS. 4-7 that the model is very accurate at predicting warps of 10% around the reference rate for clean data.

The magnitude of warps at 15% are still predicted well; however, in both the Test A Speaker and Test B Speaker cases (shown in FIGS. 5 and 6, respectively) the model fails to detect whether it is a higher or lower sampling rate detected, resulting in a warp factor of 1.15 being predicted as 0.85.

5. Example 2

Clock Drift and Jitter

In addition to the first example outlined above, a second example experiment was performed that took eight IEEE sentences that were concatenated and presented to listeners to compare a reference sample with samples under a range of ten jitter conditions.

Figure 8:
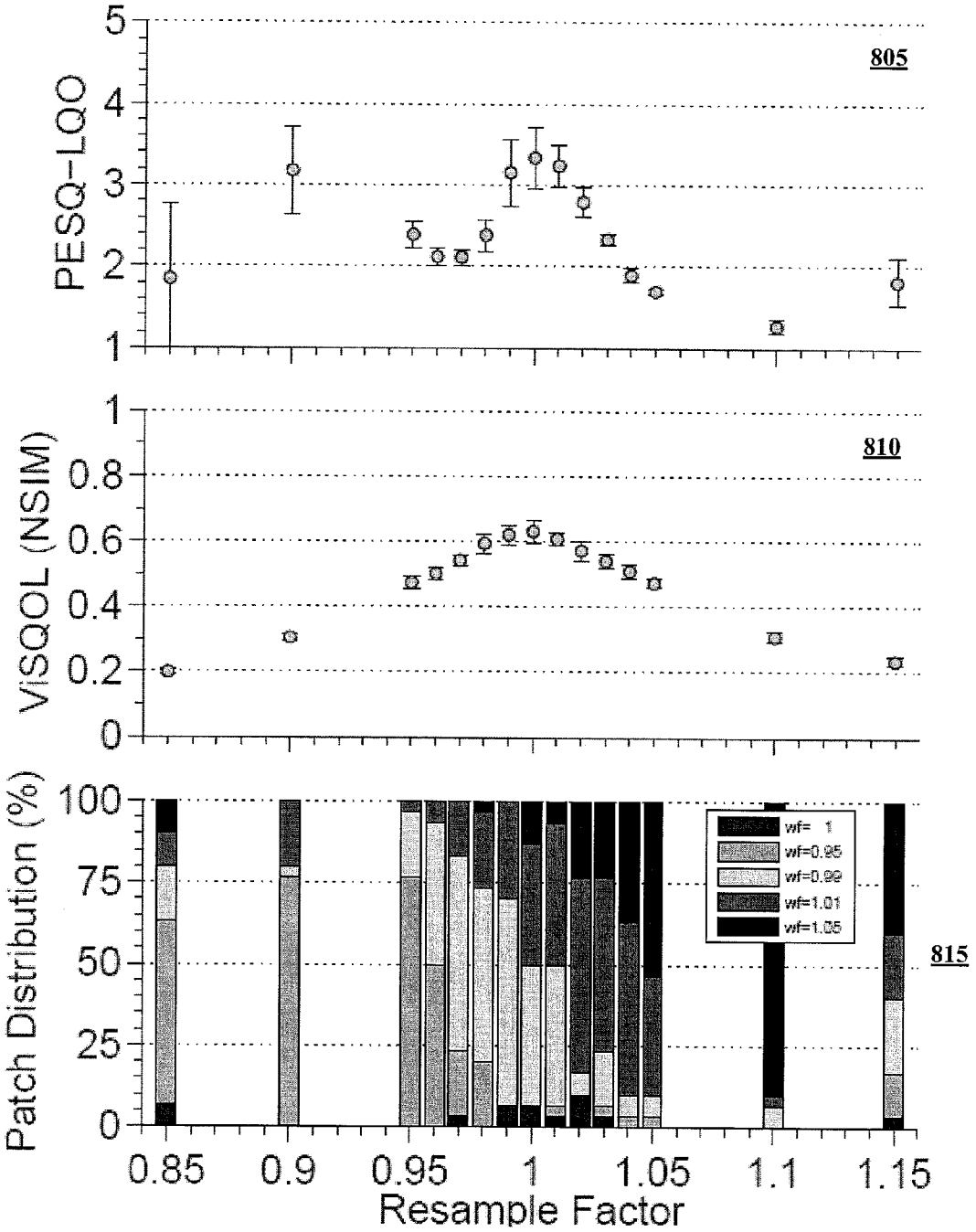
FIG. 8 is a collection of graphical representations illustrating example speech quality predictions according to one or more embodiments described herein.

In this second example, the mean MOS score for the ten conditions was 3.6 with a standard deviation of 0.23. The mean PESQ-LQO was 3.33 ($\sigma$=0.38). The jitter-degraded test signals were resampled as in Example 1, described above, and these were tested using both PESQ-LQO and the ViSQOL model. The results of these tests are shown in FIG. 8.

Figure 7:
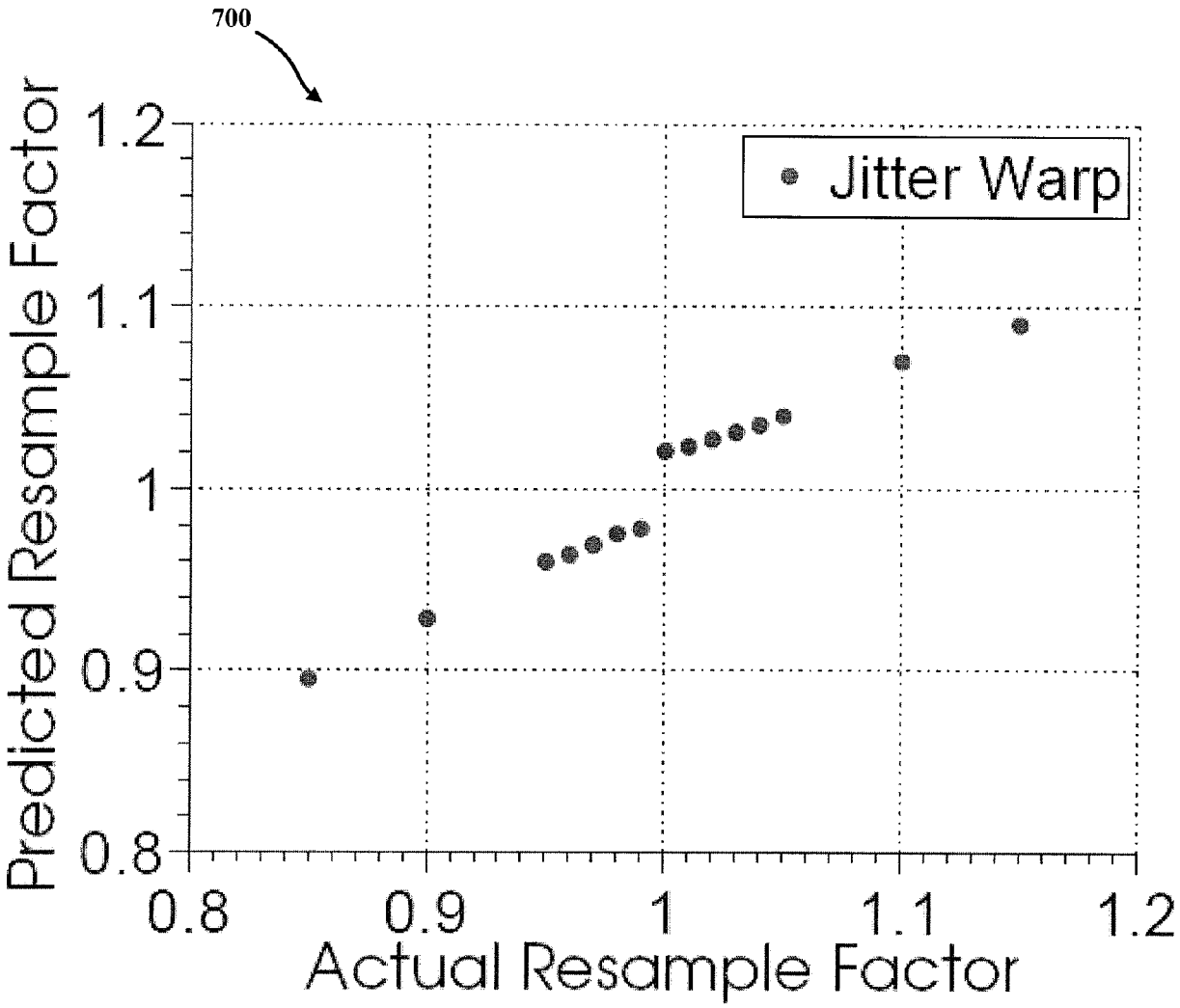
FIG. 7 is a graphical representation illustrating results of mean predicted warp for samples in an example test set according to one or more embodiments described herein.

Referring to the results of the second example experiment presented, while the PESQ-LQO results were within 0.3 of the MOS scores with jitter and no time warping, the top plot 805 shows the PESQ-LQO prediction drops significantly for warps greater than 1%. The jitter has reduced the NSIM similarity for the ViSQOL results shown in the middle plot 810. The maximum NSIM, which is the unwarped case, is just over 0.6. The trend followed, as well as the range dropping to approximately 0.4, is similar to that seen for tests without jitter in Example 1, described above and illustrated in FIGS. 4-7. The Laplace model fit was used to predict the resample factors and the scatter is shown in FIG. 7. Even with jitter distorting the similarity between the patch comparisons, ViSQOL provides a good estimate of the warping that has occurred.

6. Results

The results described herein demonstrate the ability of the ViSQOL model to detect and quantify clock drift even in the presence of other distortions such as jitter. The tests presented focus on detecting constant time warping rather than a varying warp. However, as the estimates are based on short speech samples, temporally varying warps could also be handled. This is a useful property since while there are other QoS (Quality of Service) metrics available to predict delay and clock drift, the ability of such other metrics to predict the end-user perceptual quality of experience is limited. The results highlighted the large deviation in predicted quality exhibited by PESQ for small sampling factor changes, especially in cases where other network degradations have occurred.

While various embodiments of the present disclosure were described in the context of narrowband signals, the model described herein may be adapted by adjusting the parameters of the spectrogram images to suit the wideband signals commonly used in VoIP. ViSQOL is a full objective speech quality prediction tool and a transfer function may be developed that is capable of mapping the NSIM output from the model to a predicted MOS score. Furthermore, one or more embodiments may provide the model for use in combination with PESQ to flag poor quality estimates caused by time warping.

The present disclosure relates to using ViSQOL as a model for predicting speech quality. Specifically, the ability to detect and predict the level of clock drift, and determine whether such clock drift will impact a listener's quality of experience. As was described above, ViSQOL can detect clock drift in a variety of conditions and also predict the magnitude of distortion.

Figure 9:
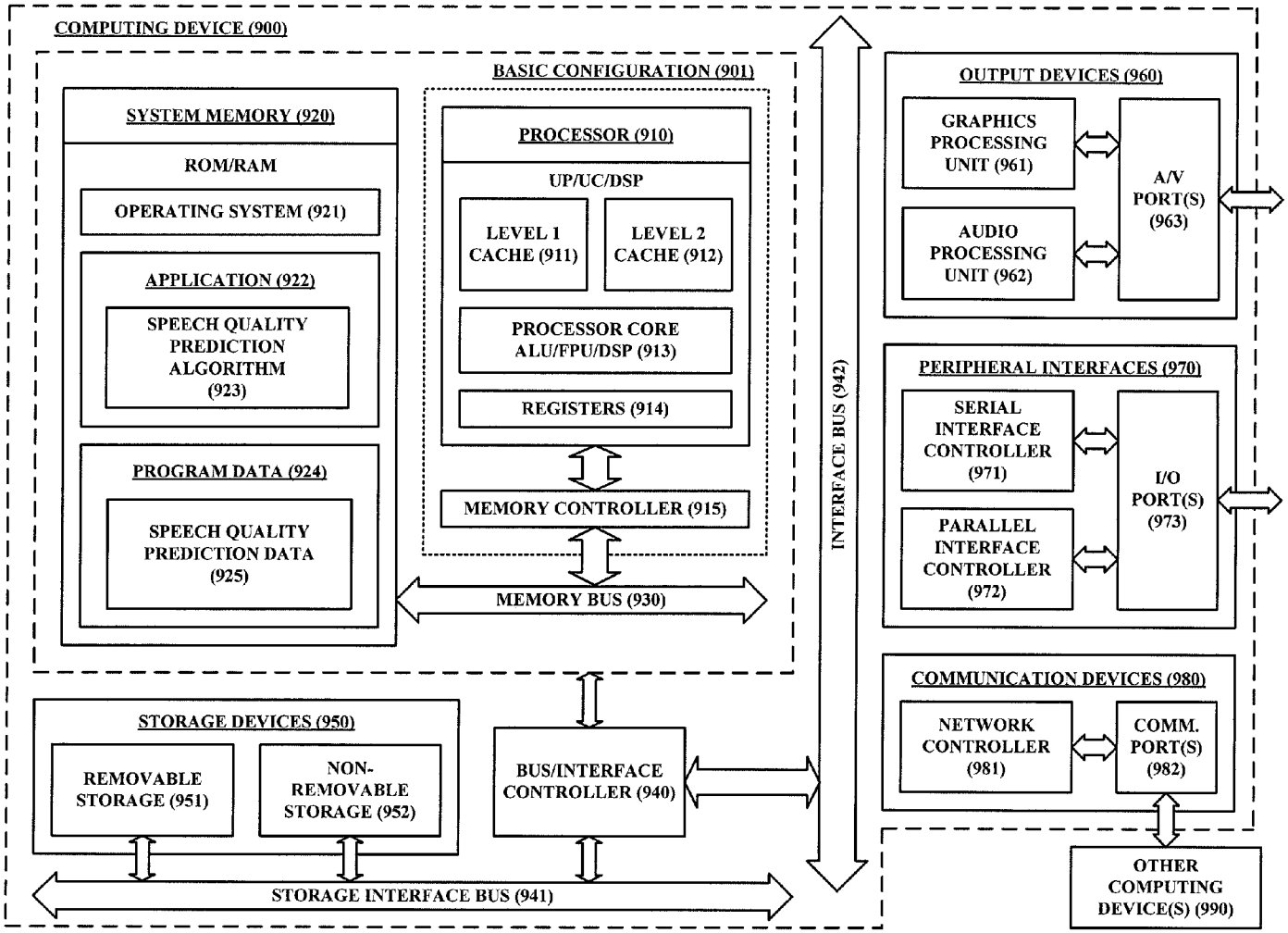
FIG. 9 is a block diagram illustrating an example computing device arranged for optimizing or selecting a post-filter without increasing rate according to one or more embodiments described herein.

FIG. 9 is a block diagram illustrating an example computing device 900 that is arranged for implementing a model for predicting speech quality. In particular, in accordance with one or more embodiments of the present disclosure, the example computing device 900 is arranged for implementing a model to detect and predict a level of clock drift, and determine whether such clock drift will impact a listener's quality of experience. In a very basic configuration 901, computing device 900 typically includes one or more processors 910 and system memory 920. A memory bus 930 may be used for communicating between the processor 910 and the system memory 920.

Depending on the desired configuration, processor 910 can be of any type including but not limited to a microprocessor (μP), a microcontroller (μC), a digital signal processor (DSP), or any combination thereof. Processor 910 may include one or more levels of caching, such as a level one cache 911 and a level two cache 912, a processor core 913, and registers 914. The processor core 913 may include an arithmetic logic unit (ALU), a floating point unit (FPU), a digital signal processing core (DSP Core), or any combination thereof. A memory controller 915 can also be used with the processor 910, or in some embodiments the memory controller 915 can be an internal part of the processor 910.

Depending on the desired configuration, the system memory 920 can be of any type including but not limited to volatile memory (e.g., RAM), non-volatile memory (e.g., ROM, flash memory, etc.) or any combination thereof. System memory 920 typically includes an operating system 921, one or more applications 922, and program data 924. In at least some embodiments, application 922 includes a speech quality prediction algorithm 923 that is configured to detect and predict a level of clock drift in a reference signal, and determine whether such clock drift will impact a listener's quality of experience. The speech quality prediction algorithm 923 is further arranged to provide a full-reference metric that uses a spectro-temporal measure of similarity between a reference signal and a test speech signal.

Program Data 924 may include speech quality prediction data 925 that is useful for detecting and predicting a level of clock drift in a reference signal. In some embodiments, application 922 can be arranged to operate with program data 924 on an operating system 921 such that a determination can be made on whether any detected clock drift will impact a listener's quality of experience.

Computing device 900 can have additional features and/or functionality, and additional interfaces to facilitate communications between the basic configuration 901 and any required devices and interfaces. For example, a bus/interface controller 940 can be used to facilitate communications between the basic configuration 901 and one or more data storage devices 950 via a storage interface bus 941. The data storage devices 950 can be removable storage devices 951, non-removable storage devices 952, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 920, removable storage 951 and non-removable storage 952 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 900. Any such computer storage media can be part of computing device 900.

Computing device 900 can also include an interface bus 942 for facilitating communication from various interface devices (e.g., output interfaces, peripheral interfaces, communication interfaces, etc.) to the basic configuration 901 via the bus/interface controller 940. Example output devices 960 include a graphics processing unit 961 and an audio processing unit 962, either or both of which can be configured to communicate to various external devices such as a display or speakers via one or more A/V ports 963. Example peripheral interfaces 970 include a serial interface controller 971 or a parallel interface controller 972, which can be configured to communicate with external devices such as input devices (e.g., keyboard, mouse, pen, voice input device, touch input device, etc.) or other peripheral devices (e.g., printer, scanner, etc.) via one or more I/O ports 973.

An example communication device 980 includes a network controller 981, which can be arranged to facilitate communications with one or more other computing devices 990 over a network communication (not shown) via one or more communication ports 982. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 900 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 900 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for determining speech quality comprising:

receiving a first signal and a second signal, wherein the second signal is a degraded version of the first signal;

creating a time-frequency representation for each of the two signals;

using the time-frequency representation for the first signal to select at least one portion of the first signal containing speech data;

identifying, based on time-frequency representation for the second signal, at least one portion of the second signal corresponding to the at least one portion of the first signal;

determining a level of similarity between the second signal and the first signal based on a comparison of the at least one portion of the second signal and the corresponding at least one portion of the first signal, wherein the level of similarity is determined using Neurogram Similarity Index Measure (NSIM); and generating a speech quality estimate based on the level of similarity determined using NSIM.

2. The method of claim 1, wherein the time-frequency representation for each of the two signals is a spectrogram.

3. The method of claim 1, wherein each of the time-frequency representations is a short-term Fourier transform (STFT) spectrogram representation created with 30 frequency bands logarithmically-spaced between 250 and 8,000 Hz.

4. The method of claim 1, wherein creating the time-frequency representation for each of the two signals includes using a 512-sample, 50% overlap Hamming window for signals with 16 kHz sampling rate and a 256-sample window for signals with 8 kHz sampling rate.

5. The method of claim 1, wherein using the time-frequency representation for the first signal to select at least one portion of the first signal containing speech data includes selecting patches of interest from the time-frequency representation for the first signal, each of the patches of interest including 30 frames of the first signal and 30 frequency bands.

6. The method of claim 1, wherein using the time-frequency representation for the first signal to select at least one portion of the first signal containing speech data includes selecting patches of interest from the time-frequency representation for the first signal, each of the patches of interest including 30 frames of the first signal and 23 frequency bands.

7. The method of claim 1, wherein using the time-frequency representation for the first signal to select at least one portion of the first signal containing speech data includes determining a maximum intensity frame in each of a plurality of frequency bands in the time-frequency representation for the first signal.

8. The method of claim 7, wherein the plurality of frequency bands correspond to 250 Hz, 450 Hz, and 750 Hz.

9. The method of claim 1, wherein identifying the at least one portion of the second signal corresponding to the at least one portion of the first signal includes performing a relative mean squared error difference between the at least one portion of the first signal and the corresponding at least one portion of the second signal to identify a maximum correlation frame index for the at least one portion of the first signal.

10. The method of claim 9, wherein the relative mean squared error difference is performed using the time-frequency representation created for the second signal.

11. The method of claim 1, further comprising:

creating warped versions of the at least one portion of the first signal;

determining a level of similarity between the at least one portion of the second signal and the corresponding at least one portion of the first signal using NSIM;

determining a level of similarity between the at least one portion of the second signal and each of the warped versions of the at least one portion of the first signal using NSIM;

calculating an average of the levels of similarity between the at least one portion of the second signal and the corresponding at least one portion of the first signal, and between the at least one portion of the second signal and each of the warped versions of the at least one portion of the first signal; and generating a signal similarity estimate based on the average of the levels of similarity determined using NSIM.

12. The method of claim 11, wherein each of the warped versions of the at least one portion of the first signal is 1% to 5% longer or 1% to 5% shorter than the at least one portion of the first signal.

13. The method of claim 11, wherein the warped versions of the at least one portion of the first signal are created using a cubic two-dimensional interpolation.

14. The method of claim 1, wherein the first signal is a short speech reference signal.

15. A system for determining speech quality, the system comprising:

one or more processors; and a computer-readable medium coupled to said one or more processors having instructions stored thereon that, when executed by said one or more processors, cause said one or more processors to perform operations comprising:

receiving a first signal and a second signal, wherein the second signal is a degraded version of the first signal;

creating a time-frequency representation for each of the two signals;

using the time-frequency representation for the first signal to select at least one portion of the first signal containing speech data;

identifying, based on the time-frequency representation for the second signal, at least one portion of the second signal corresponding to the at least one portion of the first signal;

determining a level of similarity between the second signal and the first signal based on a comparison of the at least one portion of the second signal and the corresponding at least one portion of the first signal, wherein the level of similarity is determined using Neurogram Similarity Index Measure (NSIM); and generating a speech quality estimate based on the level of similarity determined using NSIM.

16. The system of claim 15, wherein the time-frequency representation for each of the two signals is a spectrogram.

17. The system of claim 15, wherein each of the time-frequency representations is a short-term Fourier transform (STFT) spectrogram representation created with 30 frequency bands logarithmically-spaced between 250 and 8,000 Hz.

18. The system of claim 15, wherein the one or more processors are further caused to perform operations comprising creating the time-frequency representation for each of the two signals using a 512-sample, 50% overlap Hamming window for signals with 16 kHz sampling rate and a 256-sample window for signals with 8 kHz sampling rate.

19. The system of claim 15, wherein the one or more processors are further caused to perform operations comprising selecting patches of interest from the time-frequency representation for the first signal, each of the patches of interest including 30 frames of the first signal and 30 frequency bands.

20. The system of claim 15, wherein the one or more processors are further caused to perform operations comprising selecting patches of interest from the time-frequency representation for the first signal, each of the patches of interest including 30 frames of the first signal and 23 frequency bands.

21. The system of claim 15, wherein the one or more processors are further caused to perform operations comprising determining a maximum intensity frame in each of a plurality of frequency bands in the time-frequency representation for the first signal.

22. The system of claim 15, wherein the one or more processors are further caused to perform operations comprising performing a relative mean squared error difference between the at least one portion of the first signal and the corresponding at least one portion of the second signal to identify a maximum correlation frame index for the at least one portion of the first signal.

23. The system of claim 22, wherein the relative mean squared error difference is performed using the time-frequency representation created for the second signal.

24. The system of claim 15, wherein the one or more processors are further caused to perform operations comprising:

creating warped versions of the at least one portion of the first signal;

determining a level of similarity between the at least one portion of the second signal and the corresponding at least one portion of the first signal using NSIM;

determining a level of similarity between the at least one portion of the second signal and each of the warped versions of the at least one portion of the first signal using NSIM;

calculating an average of the levels of similarity between the at least one portion of the second signal and the corresponding at least one portion of the first signal, and between the at least one portion of the second signal and each of the warped versions of the at least one portion of the first signal; and generating a signal similarity estimate based on the average of the levels of similarity determined using NSIM.

25. The system of claim 24, wherein each of the warped versions of the at least one portion of the first signal is 1% to 5% longer or 1% to 5% shorter than the at least one portion of the first signal.

26. The system of claim 24, wherein the warped versions of the at least one portion of the first signal are created using a cubic two-dimensional interpolation.

* * * * *